United States Patent [19]

Maloney

[11] Patent Number: 4,557,377

[45] Date of Patent: Dec. 10, 1985

[54] MIXING BAG AND BAG MAKING APPARATUS

[75] Inventor: John Maloney, Alsager, England

[73] Assignee: Johnsen & Jorgensen Jaypak Limited, London, England

[21] Appl. No.: 541,829

[22] Filed: Oct. 14, 1983

Related U.S. Application Data

[63] Continuation-in-part of Ser. No. 444,899, Nov. 18, 1982, Pat. No. 4,540,089.

[30] Foreign Application Priority Data

Oct. 16, 1982 [GB] United Kingdom ..... 8229625
Jan. 18, 1983 [GB] United Kingdom ..... 8301279

[51] Int. Cl.[4] ..... B65D 30/24

[52] U.S. Cl. ..... 206/219; 206/568; 383/38; 383/44

[58] Field of Search ..... 206/219, 221, 222, 568; 229/75; 383/36, 40, 44, 46–48, 55–57, 59, 38

[56] References Cited

U.S. PATENT DOCUMENTS

| | | | |
|---|---|---|---|
| 2,800,269 | 7/1957 | Smith | 206/219 |
| 3,065,899 | 11/1962 | Means et al. | 383/46 |
| 3,189,252 | 6/1965 | Miller | 383/57 |
| 3,297,152 | 1/1967 | Corella | 383/44 |
| 3,367,485 | 2/1968 | Schneider et al. | 383/44 |
| 3,419,258 | 12/1968 | Ritchie | 206/219 |
| 3,545,604 | 12/1970 | Gunther, Jr. | 229/75 |
| 3,565,738 | 2/1971 | Kirkpatrick | 383/62 |
| 4,391,404 | 7/1983 | Welter | 383/46 |

FOREIGN PATENT DOCUMENTS

| | | | |
|---|---|---|---|
| 0732026 | 4/1966 | Canada | 383/48 |
| 1180265 | 10/1964 | Fed. Rep. of Germany | 206/219 |
| 1366310 | 6/1964 | France | 206/219 |

*Primary Examiner*—George E. Lowrance
*Assistant Examiner*—Jimmy G. Foster
*Attorney, Agent, or Firm*—Neil F. Markva

[57] ABSTRACT

A bag suitably for mixing has a compartment, a pocket in the bag having a mouth opening so that either it can be filled with liquid to a predetermined volume or it can receive a dispensing member. The pocket is easily ruptured when the mouth is closed and, when mixing, a volume of liquid may be discharged into the compartment for mixing with a material in the compartment. During mixing the walls of the pocket abut to serve as a non-return valve in the bag.

Apparatus for making the bags includes web bonding means, feeding means to feed film of waterproof thermoplastics material from rolls to the bonding means, and interrupting means to form the mouth in the pocket.

The apparatus may form bags with open bottoms for insertion of the material for mixing and subsequent closure or sealed, filled bags.

7 Claims, 19 Drawing Figures

MIXING BAG AND BAG MAKING APPARATUS

RELATED APPLICATION

This is a continuation-in-part of my copending application Ser. No. 444,899 filed Nov. 18, 1982, now Pat. No. 4,540,089, entitled "Bag and Bag Making Apparatus.

TECHNICAL FIELD

This invention relates to the provision of a bag made from flexible waterproof film material with a compartment and a pocket within the bag. The invention is also concerned with packaging liquids, dry materials or of materials which are to be mixed with a liquid to form a mixture. Many materials which require mixing are known, e.g. dry mortar in pulverulent form, plaster powder, and food or beverage making mixture such as a cake mixture. However, the packaged material whether, liquid or solid will be referred to as a desired material.

The mixing of a material with a liquid is often a messy proceeding, involves the subsequent cleaning of the surface or receptacle and the implement used to perform the mixing, and sometimes involves the risk of spillage of the material or mixture causing damage; and an object of the invention is to enable these disadvantages to be reduced or obviated.

Furthermore, the mixing of such a material with a liquid usually requires a predetermined or selected amount of the material to be mixed with a predetermined or proportionate amount of liquid, the latter, at least, having to be measured by the user. The measuring operation is often inconvenient to perform and is sometimes omitted by persons who estimate or guess the amount of liquid to the possible detriment of the performance of the mixture produced, and an object of the invention is to enable this inconvenience to be reduced or obviated.

SUMMARY OF THE INVENTION

According to the present invention there is provided a bag formed from flexible waterproof film material with a compartment and a pocket within the bag characterized in that:

(a) the bag has opposed walls and is provided with a mouth;

(b) the pocket defined by the opposed walls is interposed between the compartment and the mouth;

(c) at least a portion of the pocket is frangible to allow the pocket to be ruptured;

(d) the said opposed walls are adapted to assume a self-sealing position after rupture of the pocket so as to serve as a non-return valve between the compartment and the mouth.

In one form of the invention the bag is filled during sealing, in another form the compartment is left with a material insertion opening which is sealed subsequently.

In more detail and with the object of mixing a liquid with a dry powdered material there is provided a bag, formed from flexible waterproof film material with a compartment containing material for mixing with a liquid, and a pocket, within the bag; characterized in that:

(a) the bag has opposed walls and is provided with a mouth which serves as an opening for insertion of liquid into the pocket;

(b) the pocket defined by the opposed walls is interposed between the compartment and the mouth to provide a hermetic seal therebetween;

(c) the pocket is adapted to hold a predetermined quantity of liquid so as to serve as a measure, and at least a portion of the pocket is frangible to allow the pocket to be ruptured to discharge measured liquid into the compartment; and in that (d) the said opposed walls are adapted to assume a face to face abutting relationship when the liquid has been discharged from the pocket into the compartment after rupture of the pocket so that the abutting faces are held together in a self-sealing position by a thin film of the liquid that remains on the abutting faces after the liquid has been discharged from the pocket so that the abutting faces serve as a non-return valve obstructing the passage of liquid and material to the mouth, so as to permit the bag to retain the contents during mixture thereof by manipulation of the bag.

According to the present invention there is also provided apparatus, for making bags, comprising feeding means and bonding means, the feeding means being arranged to feed a plurality of films of waterproof thermoplastics material through the bonding means, and the latter being arranged to form bonds between said films, wherein the bonding means comprises confronting members disposed at opposite sides of a web transit path therebetween, which members are mounted so that the spacing therebetween can be varied to cause the members to abut webs of said films located in said web transit path, the apparatus being characterized in that a web separator member is provided in said web transit path between at least portions of two of said confronting members to separate portions of adjacent webs to prevent bonds being made to those surfaces of said portions which abut the web separator while allowing bonds to be made to the other surfaces of said portions at each side of the web separator by said at least two portions for forming mouths for the bags.

The present invention also provides a method of making bags from films of thermoplastic material, wherein a plurality of webs of said films are superimposed upon each other and are fed along a web transit path between confronting members of bonding means, characterized in that portions of adjacent webs are spaced apart to prevent bonds being made between said spaced apart portions of two of said webs as said bonding means is actuated to form bonds between said portions of said webs and others of said webs.

The bag is preferably formed so that the walls of said pocket are formed from a single membrane disposed between opposed outer walls of the bag so as to project into the compartment, and said single membrane is preferably of a material which is thinner than the material from which the outer walls are formed. This form of bag has given highly satisfactory results under test conditions and is very convenient to manufacture upon the apparatus of the invention.

In one form of the invention the apparatus is preferably adapted so as:

(a) to unroll two sheets of relatively robust plastics film and to unroll a lay-flat tube of a relative frangible plastics film;

(b) to feed said films to slitting means so that the tube is sandwiched centrally between the sheets and so that the sandwich of sheet and tube is slit longitudinally to form two separate runs in each of which one half of the tube constitutes an intermediate film which is folded to give two abutting intermediate webs disposed between two outer webs of the sheet film;

(c) to separate portions of said abutting intermediate webs and to form a predetermined seam between each said portion and an abutting portion of the adjacent web of relatively robust sheet film, for forming the mouths of the bags; and (d) to form further seams between said webs to form bags having open ends defined between confronting portions of said webs of relatively robust film, for use as material insertion openings for admitting contents into compartments in the bags prior to the closure of said open ends to close said compartments.

Said further seams are preferably formed so that each bag is made in two stages, at least some of the seams lying, in the direction of movement of the webs, downstream of the predetermined seam being formed first and then the remaining seams being formed after the run has been advanced to move said predetermined seam from the separator.

The separator preferably comprises a fixed support disposed between the runs so as to locate a planar heat resistance member in a position in which it extends into each half of said tube.

The members preferably each include an array of heating elements, and one element of each array is preferably easily positionally adjustable so that the position of a seam made by said adjustable elements can be varied relative to said predetermined seam, for making a preferred form of the bag wherein the volume of said pocket is restricted by a seam separating a usable portion of the pocket from a closed and unfillable portion.

The invention includes bags made by the apparatus or method of the invention.

BRIEF DESCRIPTION OF DRAWINGS

The invention will now be described, by way of example, with reference to the accompanying diagrammatic drawings, in which.

DESCRIPTION OF THE PREFERRED EMBODIMENTS

All embodiments of the apparatus comprise bonding means, and feed means.

Figure 3:
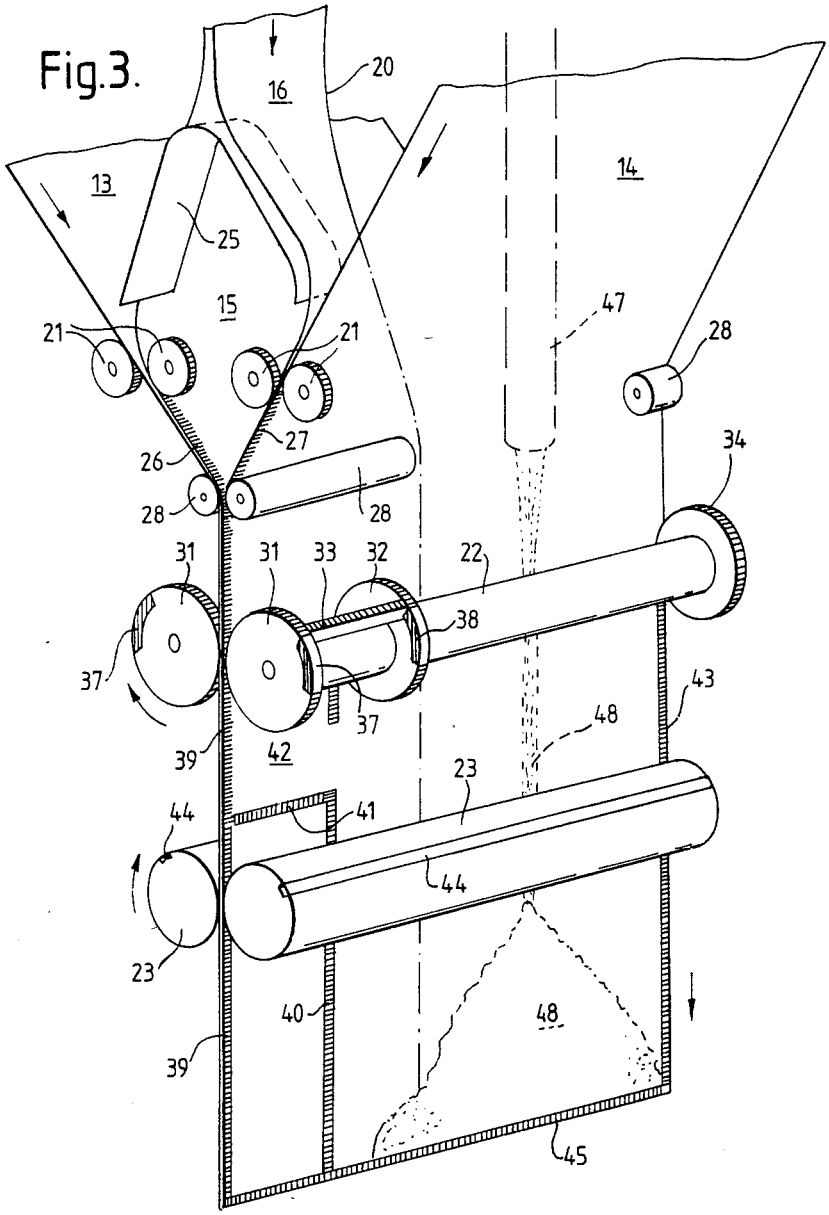
FIG. 3 is an enlarged view of part of the apparatus shown in FIG. 1.
Figure 4:
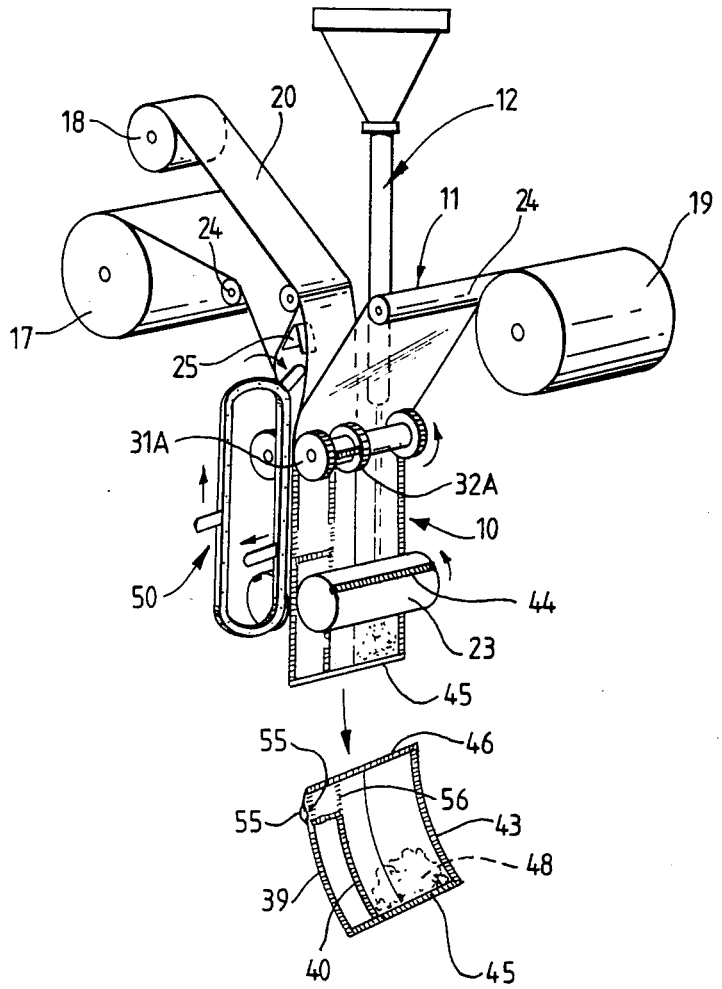
FIG. 4 shows a second embodiment of apparatus of the invention.

In the first embodiment shown in FIGS. 1 and 3, the bonding means 10 comprises a first set of four rotary members 21, a second set of two rotary members 22 and a third set of two rotary members 23; together with interrupting means incorporated into the second set as hereinafter described.

The feed means 11 comprises rollers 24 and guides 25 which conduct outer webs 13, 14 and inner webs 15 and 16 from rolls 17, 18 and 19 to the bonding means 10. The outer webs 13,14 are of relatively strong sheet thermoplastics material, whereas the inner webs 15 and 16 are constituted by a single longitudinally folded strip of a weaker sheet thermoplastics material, the webs 15 and 16 being joined by a longitudinal fold 20.

The guides 25 serve to separate the webs 15 and 16 before reaching the first set of members 21. The members 21 are electrically heated heat sealing rollers arranged in two pairs, each pair defining a nip between which longitudinal margins of the webs are fed, so that one pair produces a continuous seam 26 between the webs 13 and 15, and the other pair produces a continuous seam 27 between the webs 14 and 16, as shown in FIG. 3.

Further rollers 28 serve to bring all marginal portions of the webs 13 to 16 together ahead of the second set. Each member 22 of the second set comprises first and second arcuate peripheral electrically heated heat sealing portions 31 and 32 linked by a linear peripheral heat sealing portion 33, and a circular peripheral heat sealing portion 34 remote from the portions 31 and 32. The first and second portions 31 and 32 are interrupted by respective gaps 35, 36 (FIG. 1) or unheated peripheral portions 37, 38 (FIG. 3) which constitute the interrupting means.

The portions 31 together form a seam 39 and the portions 32 form a parallel seam 40 of equal length, and a short transverse seam 41 is formed by the portions 33 to join the ends of the seams 39 and 40 alongside a mouth part 42 of each bag. The seams 39, 30 and 41 connect all four webs together. Similarly, the portions 34 produce a continuous longitudinal seam 43 joining the marginal other portions of the outer webs 13 and 14.

The rotary members 23 each have a double seaming and severing linear peripheral part 44 which produces two parallel transverse seams 45 and 46 and severs the seamed together webs between these seams 45 and 46, so that the just formed seam 45 remains on the bag being formed while the seam 46 closes the last formed bag.

The seam 45 joins the other ends of the seams 39 and 40, so that the area of the bag defined between the seams 39, 40, 41 and 45 serves as a handle or holdable portion of the bag; and the seam 46 serves to connect the webs together at the end of the mouth part 42 remote from the seam 41.

The filler means 12 may comprise a duct 47 which directs material 48 for mixing to between the outers webs 13 and 14 so that the material comes to rest on the seam 45 of the bag being formed.

The finished bag is similar to that described in my present application Ser. No. 444,899 now U.S. Pat. No. 4,540,089 and has an open mouth 49 leading into a measuring pocket bounded by the webs 15 and 16, leaving a sealed compartment in which the material 48 is disposed.

The second embodiment employs many parts identical with parts of the first embodiment, which parts are indicated by the same reference numerals and are not described further, and modified parts are indicated by the addition of the suffix A. In this embodiment the first set of rotary members 21 is omitted, and the bonding means 10 employs an alternative interrupting means 50, and modified first and second portions 31A and 32A. These modified portions 31A and 32A are circular and are capable of producing continuous longitudinal seams.

Figure 5:
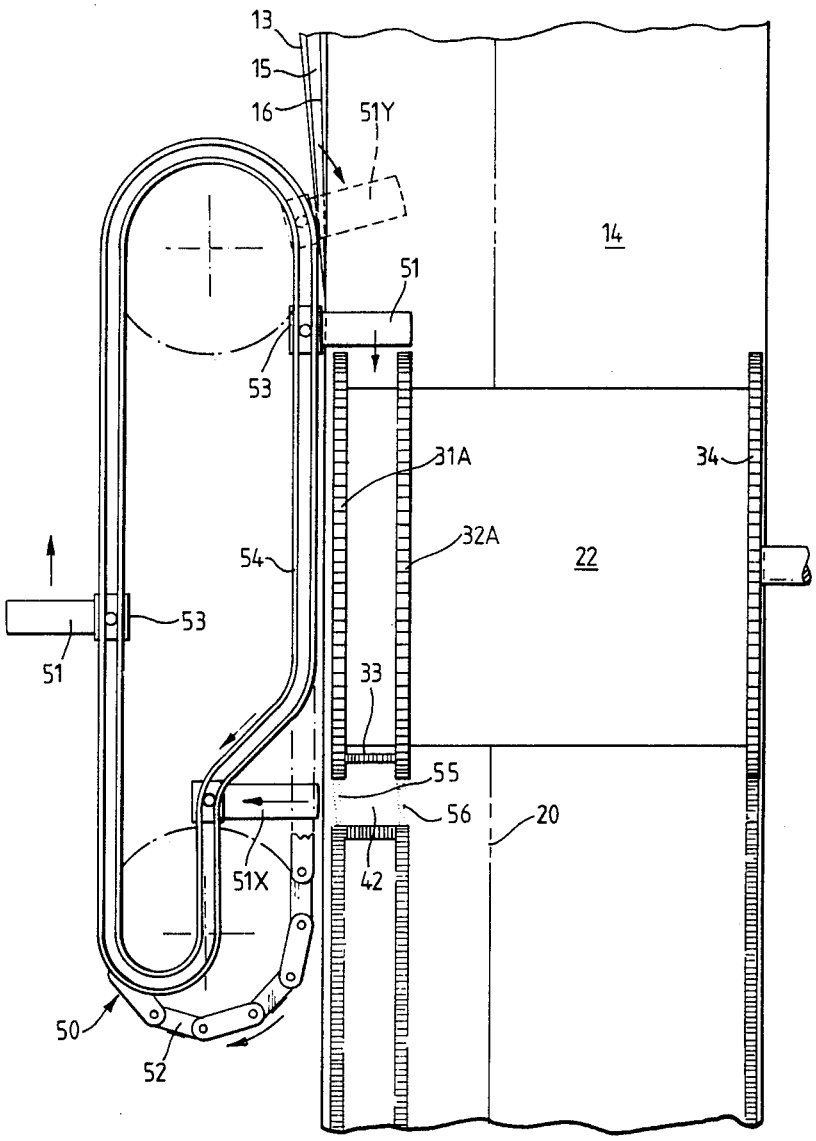
FIG. 5 shows an enlarged view of part of the apparatus shown in FIG. 4.
Figure 6:
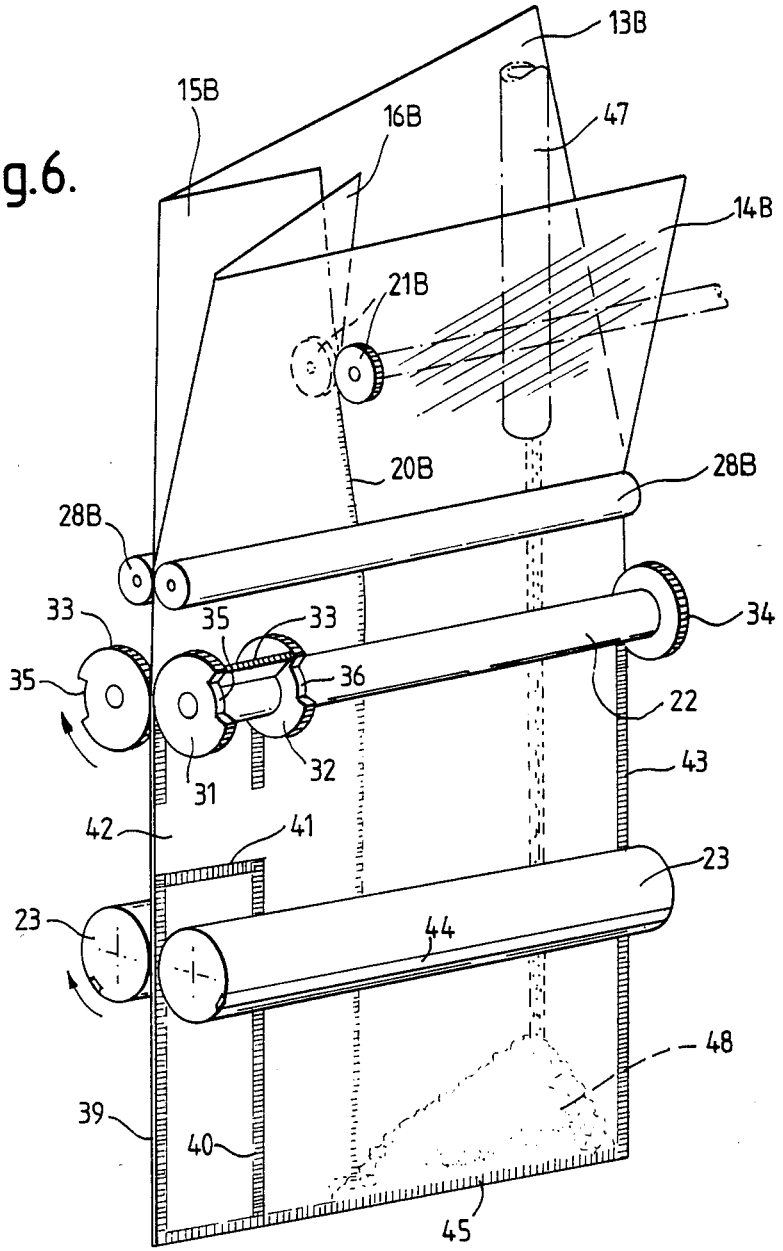
FIG. 6 shows parts of a third embodiment of apparatus of the invention.

The interrupting means 50 (FIG. 5) comprises blades 51, of a material which is resistant to bonding to thermoplastics materials, mounted on a belt or chain 52 of a rotary support mechanism by means of carriers 53 which engage guide means 54 to move the blades from a retracted condition, e.g. the blade 51X, to a projecting condition, e.g. the blade 51Y as the blades 51 are carried round a predetermined path by the belt or chain. The belt or chain 52 is driven in unison with the sets of rotary members so that each blade 51 is inserted between the inner webs 15 and 16 and moves therewith to between the portions 31A and 32A to prevent seams being formed between the mouth portions of these webs 15 and 16 while permitting seams 55 and 56 being formed between these mouth portions and the abutting mouth portions of the outer webs 13 and 14. Thereafter, the blade 51 is retracted from the mouth prior to the seam 46 being made alongside the mouth. Except for the extra seams 56, the bag is the same as that shown in FIG. 2.

The third embodiment of apparatus again employs many of the parts of the first embodiment which parts are either omitted or indicated by the same reference numerals, together with some modified parts indicated by the addition of the suffix B. This embodiment is adapted to make a bag from two strips of sheet material, in which each sheet is folded to provide an outer web 13B or 14B and an inner web 15B or 16B.

Figure 1:
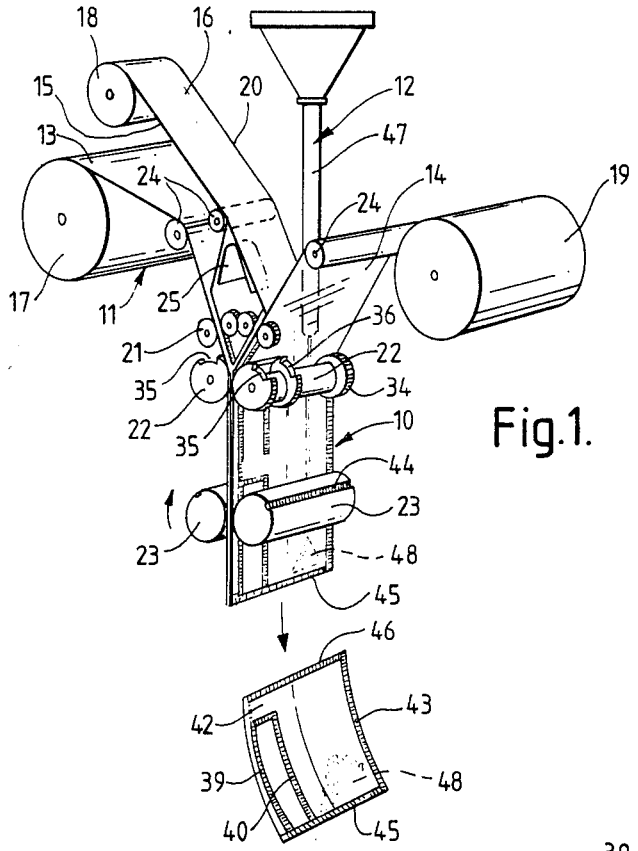
FIG. 1 shows a first embodiment of apparatus of the invention.
Figure 2:
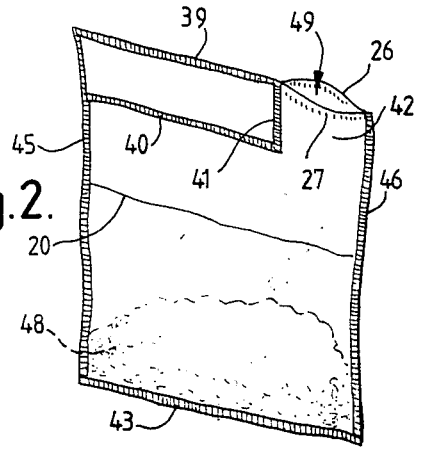
FIG. 2 is an enlarged view of a bag formed by the apparatus shown in FIG. 1.

The first set comprises only two members 21B which are arranged to form a continuous frangible or weak seam 20B or a seam 20B having weak or frangible portions, between the inner marginal portions of the webs 15B and 16B, at the same position as the fold 20 in FIGS. 1 and 2. The bags so formed are functionally equivalent to the bags shown in FIGS. 1 and 2, except in that the seam 20B is frangible instead of the webs 15 and 16 being frangible.

Instead of prefolding the strips of sheet material, two unfolded sheets may be seemed together by one pair of members 21 or 21B and then the joined sheets may be folded to form the webs 13,14,15B and 16B prior to the webs reaching the rollers 28B.

The foregoing forms of apparatus are arranged to form the bags of the type shown in FIG. 2 but may be adapted to produce simpler smaller bags for "shake-mix" materials which, when mixed with approximately the correct amount of liquid, produce a fluent liquid product e.g. a drink. The fourth embodiment of apparatus is adapted to produce such simple bags from the webs 13 and 14 which bags are not particularly suitable for mixing viscous or semi-liquid products or products which require vigorous, prolonged mixing or transport or storage after mixing, because they lack the self-closing automatic non-return valve function of the webs 15,16 or 15B, 16B inherent in the previously mentioned bags.

Figure 7:
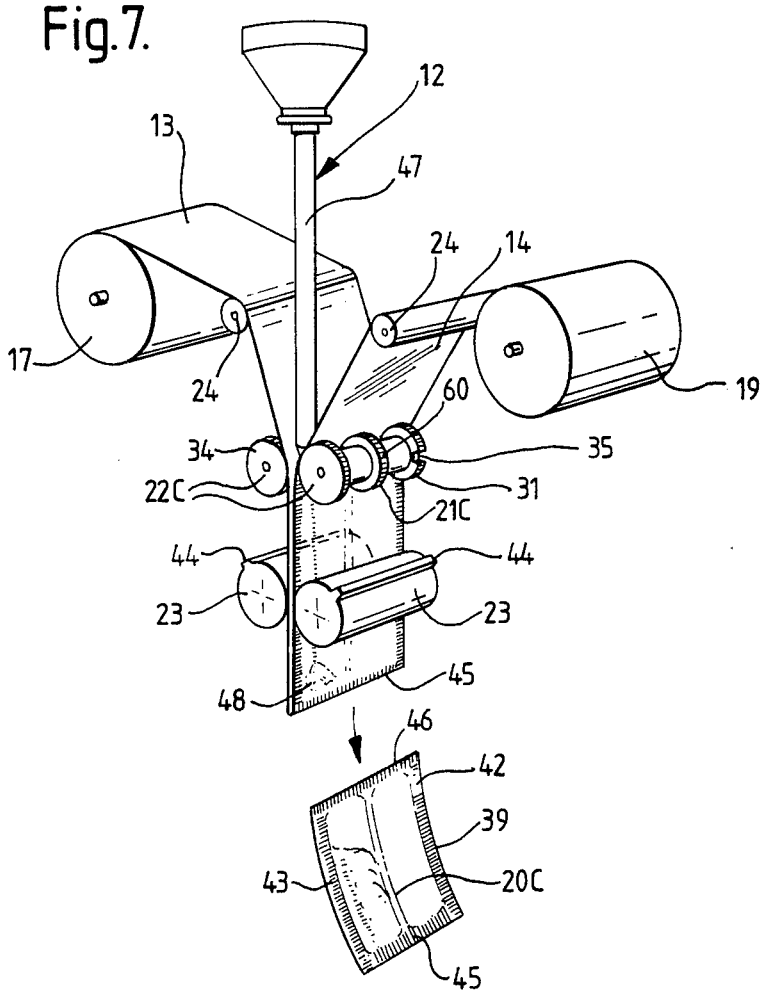
FIG. 7 shows a fourth embodiment of apparatus of the invention.

In FIG. 7 those parts which are functionally equivalent to parts previously described are indicated by the same reference numerals whereas modified parts are indicated by the addition of the suffix C. In this embodiment the members 21C are transposed to the members 22C so as to provide sealing portions 60 which produce a weak barrier seam 20C between the stronger seams 39 and 43 produced by the portions 31 and 34 so that the bags comprise a compartment in which the material 48 is disposed, and a measuring pocket having a mouth between the mouth parts 42. When the pocket is filled with liquid the mouth can be held closed and the pocket squeezed to rupture the bond 20C between the webs 13 and 14 to allow mixing of the material and liquid within the bag.

Figure 8:
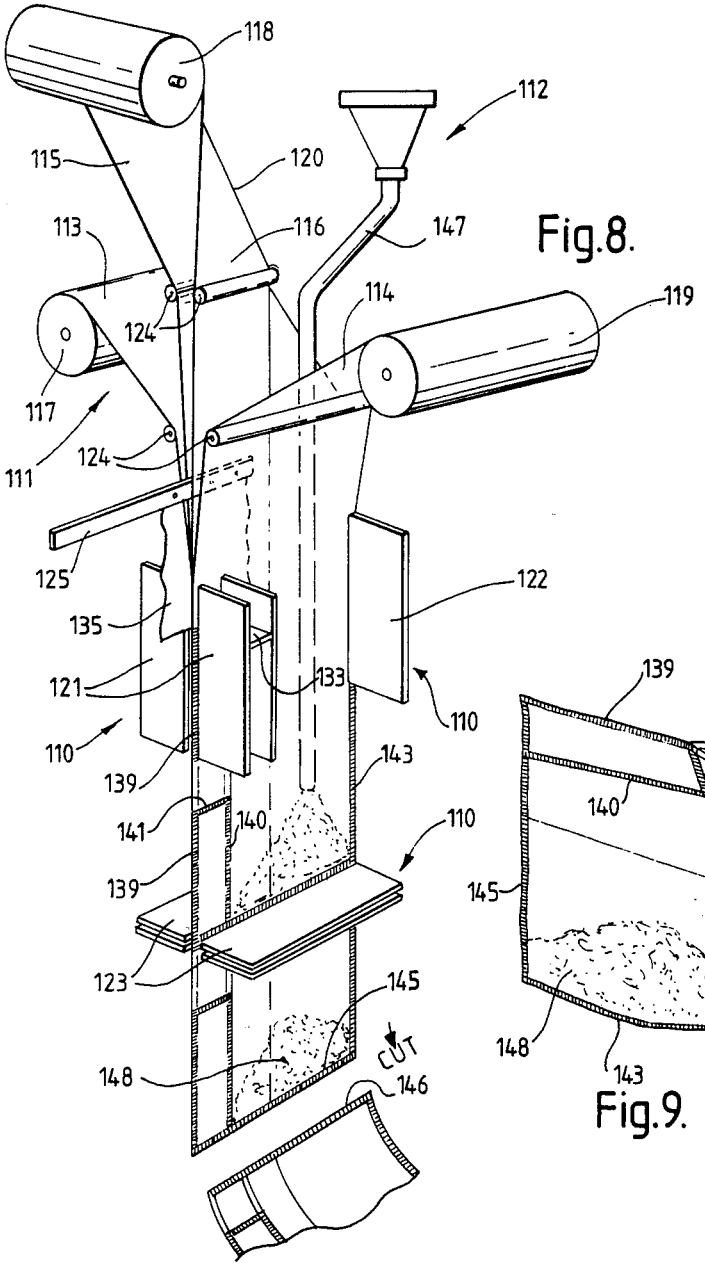
FIG. 8 shows a fifth embodiment of apparatus of the invention.
Figure 9:
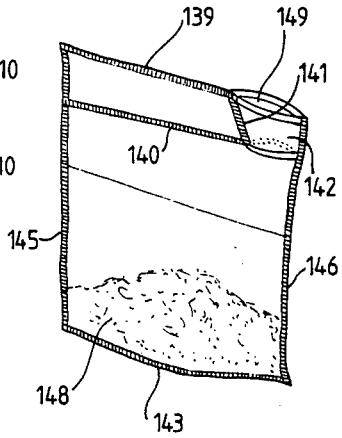
FIG. 9 is an enlarged view of a bag formed by the apparatus shown in FIG. 8.

In the first four embodiments of the invention the various seams have been formed by rotary bonding means but in the embodiment shown in FIGS. 8 and 9 the bonding means comprises cooperating reciprocating bonding members. Therefore, the references used in FIGS. 8 and 9 are in the one hundred series but, where possible, their numbers correspond to equivalent numbering in the earlier embodiments.

In the embodiments shown in FIGS. 8 and 9, the bonding means 110 comprises a first set of reciprocable bonding or sealing members 121 and a second set of reciprocable bonding or sealing members 122 and a third set of reciprocable members 123 together with interrupting means as hereinafter described.

The feed means 111 comprises rollers 124 and guides 125 which conduct outer webs 113, 114 and inner webs 115 and 116 from rolls 116, 118 and 119 to the bonding means 110. The outer webs 113, 114 are of relatively strong sheet thermoplastics material, whereas the inner webs 115 and 116 are constituted by a single longitudinally folded strip of a weaker sheet thermoplastics material, the webs 115 and 116 being joined by a longitudinal fold 120.

The guides 125 serve to separate the webs 115 and 116 prior to these webs reaching the first set of bonding members 121. The members 121 may be electrically heated heat sealing plate members arranged in pairs defining a nip between the members into which longitudinal margins of the webs are fed to produce a continuous seam 139 between the webs 113 and 115, which forms the top seam of the bag shown in FIG. 9 leaving the mouth 149 unsealed due to the presence of interrupting means 135. At the same time sealing or bonding members 121 form seams 140 and 141 and bonding members 122 form seam 143.

The outer members 121 therefore together form the seam 139 and the inner members 121 form the parallel seam 140 preferably of slightly longer length, and a short transverse seam 141 is formed by the portions 133 to join the ends of the seams 139 and 140 alongside a throat part 142 of each bag. The seams 139, 140 and 141 connect all four webs together. Similarly, the members 122 produce a continuous longitudinal seam 143 joining the marginal outer portions of the outer webs 113 and 144 to form the bottom of the bag.

The bonding members 123 each have a double seaming and severing function which produces two parallel transverse seams 145 and 146 and severs the seamed together webs between these seams 145 and 146, so that the just formed seam 145 remains on the bag being formed while the seam 146 closes the last formed bag.

The seam 145 joins the ends of the seams 139 and 140, remote from the mouth, so that the area of the bag defined between the seams 139, 140, 141 and 145 serves as a handle or holdable portion of the bag; and the seam 146 serves to connect the webs together at the end of the throat part 142 remote from the seam 141.

The filler means 112 may be of known form comprising a duct 147 which directs material 148 between the outer webs 113 and 114 so that the material during manufacture of the bag comes to rest on the seam 145 of the bag being formed.

As with earlier embodiments the finished bag has an open mouth 149 leading into a pocket bounded by the webs 115 and 116, leaving a sealed compartment in which the material 148 is disposed. Reciprocating bonding means may also be used to form the bag of simpler construction described with reference to FIG. 7.

Alternatively, the bonding means may be flexibly mounted to allow the bonding means limited movement with the webs so that sealing can be effected while the webs are moving through the machine, spring means or the like being provided to return the bonding means to their original position. In another embodiment not shown the bonding means may be mounted for movement around a track in a manner similar to the mounting of the interruption means 51 in FIG. 5.

Thus, the bonding means are reciprocated inwardly towards the webs to form a nip to effect bonding and move with the webs during bondings. Therefore, a machine in accordance with the invention may be provided with any form of bonding means or suitable combination thereof. As one further example, the longitudinal bonding means could be rotary and the transverse bonding and cutting means could conveniently be reciprocable.

Figure 10:
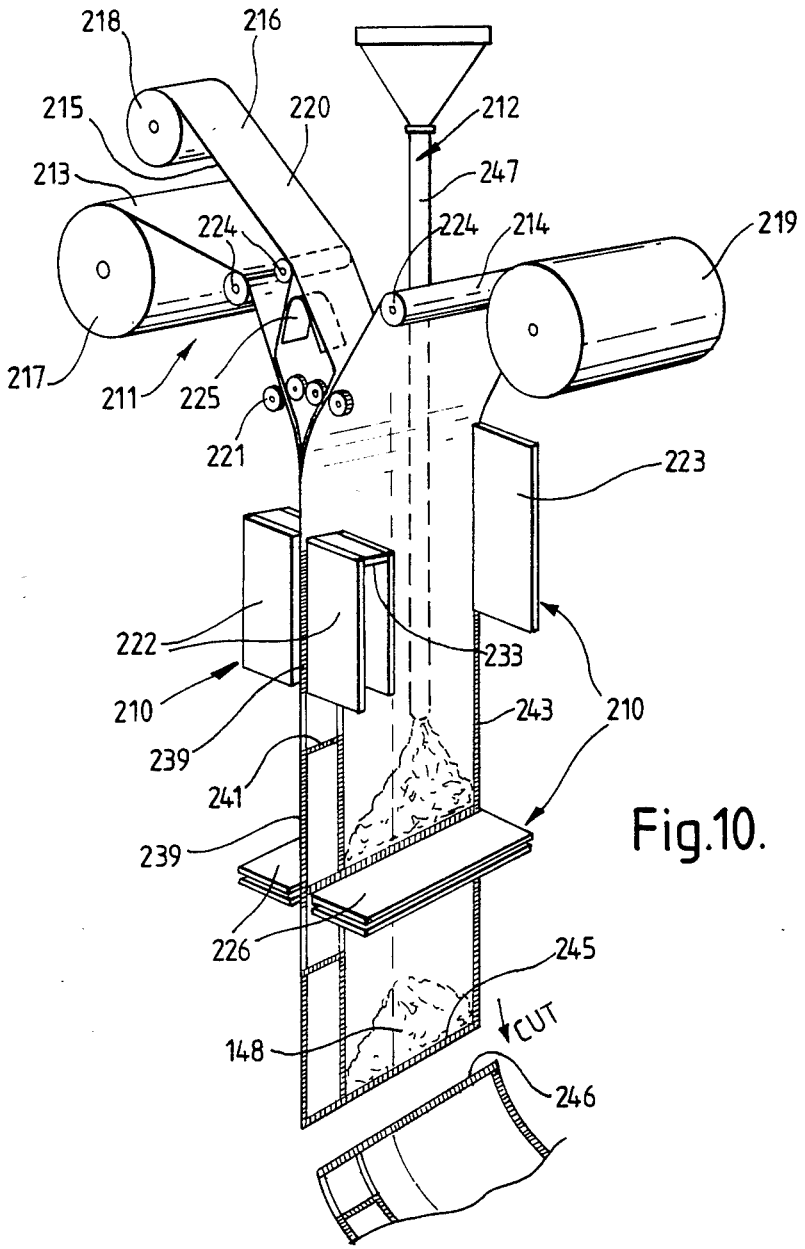
FIG. 10 is a sixth embodiment of apparatus of the invention.

Another example is illustrated in the embodiment shown in FIG. 10 where the bonding means 210 comprises a first set of four rotary members 221, a second set of reciprocating members 222, a third set of reciprocating members 223 and a fourth set of reciprocating members 226.

The feed means 211 comprises rollers 224 and guides 225 which conduct outer webs 213, 214 and inner webs 215 and 216 from rolls 217, 218 and 219 to the bonding means 210. The outer webs 213, 214 are of relatively strong sheet thermoplastics material, whereas the inner webs 215 and 216 are constituted by a single longitudinally folded strip of a weaker sheet thermoplastics material, the webs 215 and 216 being joined by a longitudinal fold 220.

The guides 225 serve to separate the webs 215 and 216 prior to these webs reaching the first set of members 221. The members 221 are electrically heated heat sealing rollers arranged in two pairs, each pair defining a nip between which longitudinal margins of the webs are fed, so that one pair produces a continuous seam between the webs 213 and 215, and the other pair produces a continuous seam between the webs 214 and 216.

The marginal portions of the webs 213 and 216 are then brought together at the second set of reciprocable bonding or sealing members 222 and the third set of reciprocable bonding or sealing members 223. The second set of reciprocable members 222 are shorter in longitudinal length than the members 223 so as to form the interruption necessary for the mouth opening of the bag as will be explained. The fourth set of reciprocable members 226 form the transverse seam as in the embodiment of FIG. 8.

The members 222 may be electrically heated heat sealing plate members arranged in pairs defining a nip between the members into which longitudinal margins of the webs are fed to produce a continuous seam 239 between the webs 213 and 215, which forms the top seam of a bag leaving the mouth 249 unsealed due to the interruption caused by the relative length of the plate members 222.

At the time of sealing of bonding members 222 form seams 240 and 241 and bonding members 223 form seam 243.

The outer members 222 therefore together form the seam 239 and the inner members 222 form the parallel seam 240 preferably of slightly longer length, and a short transverse seam 241 is formed by the portions 233 to join the ends of the seams 239 and 240 alongside a throat part of each bag. The seams 239, 240 and 241 connect all four webs together. Similarly, the members 223 produce a contintuous longitudinal seam 243 joining the marginal outer portions of the outer webs 213 and 244 to form the bottom of the bag.

The bonding members 226 each have a double seaming and severing function which produces two parallel transverse seams 245 and 246 and severs the seamed together webs between these seams 245 and 246, so that the just formed seam 245 remains on the bag being formed while the seam 246 closes the last formed bag.

The seam 245 joins the ends of the seams 239 and 240, remote from the mouth, so that the area of the bag defined between the seams 239, 240, 241 and 245 serves as a handle or holdable portion of the bag; and the seam 246 serves to connect the webs together at the end of the throat part 242 remote from the seam 241.

The filler means 212 may comprise a duct 247 which directs material 248 between the outer webs 213 and 214 so that the material during manufacture if the bag bag comes to rest of the seam 245 of the bag being formed.

Figure 11:
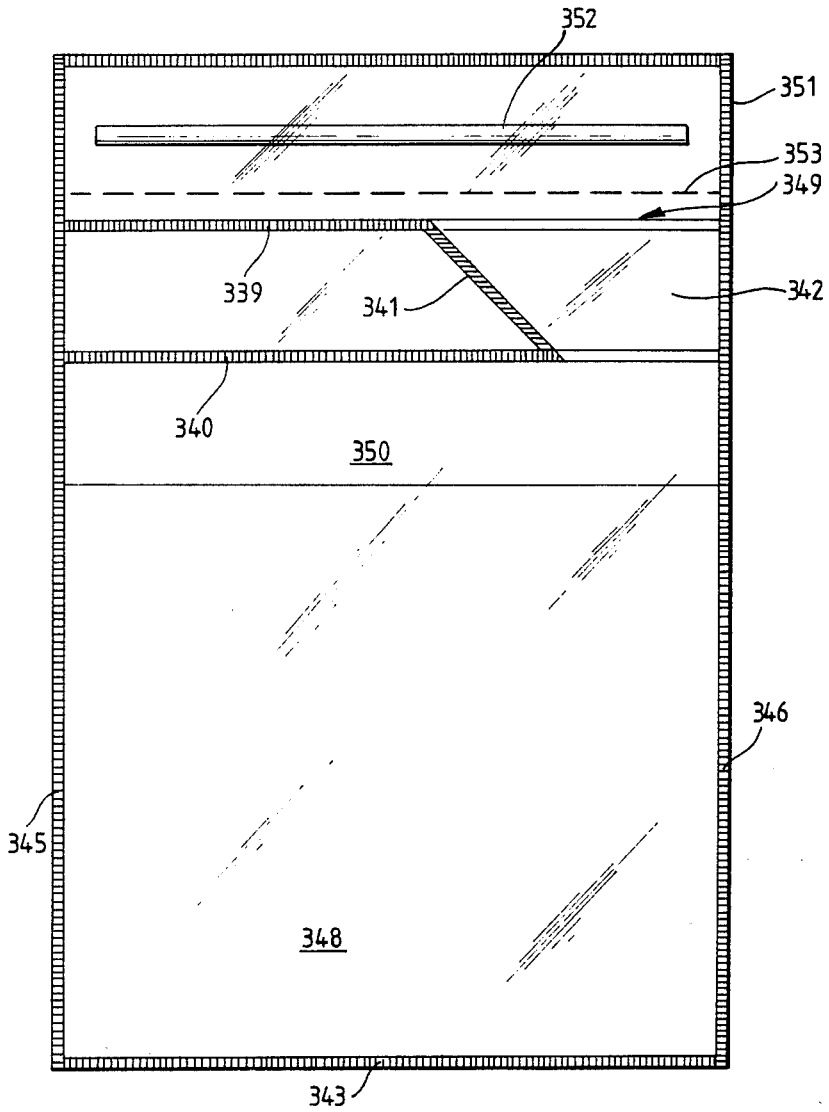
FIG. 11 is an enlarged view of an alternative bag.
Figure 12:
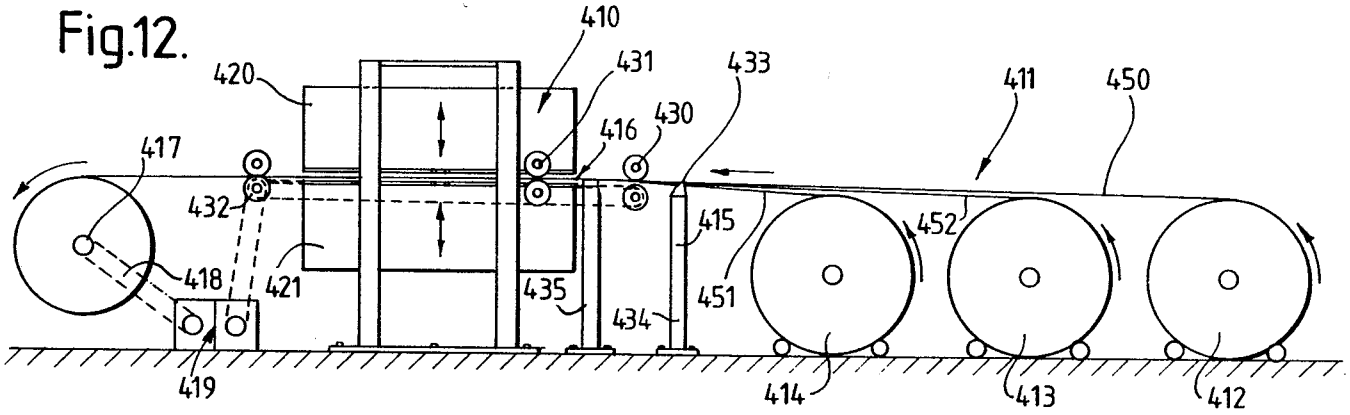
FIG. 12 shows a schematic layout of an alternative bag making apparatus according to the invention.

FIG. 11 shows a bag similar to that disclosed in FIG. 9 and similar reference numerals in the three hundred series have been used. The bag has a sealed compartment 348, a pocket 350, bounded by the inner webs the same as webs 115, 116, and a mouth 349 leading to the pocket. However, in addition the bag includes a top section 351 in which is received a straw or tubular power or dispenser 352. The top section 351 allows the bag to be completely sealed about its periphery and then the bag may be opened by tearing away the top section 351 along the line of perforations 353. The straw 352 may then be removed, inserted into the mouth 349 and used to rupture the barrier between the pocket 350 and the compartment 348. Thus the sealed compartment 348 may include a liquid drink ready for consumption either by sucking through the straw 352 or by using the straw 352 as a pourer. Alternatively the sealed compartment may include Milk shake powder or orange drink crystals or the like in which case the pocket 350 may be used as a measure.

The bag, particularly in larger sizes, may be used for the packaging of dry powders such as coffee granules and washing powder where the mouth 349 serves as a guide for a dispenser provided as in FIG. 11 or provided separately. In such a case the pocket 350 provides a hermetic seal before use and, after rupture of the pocket, provides a one way valve as with liquid.

The apparatus in FIGS. 12 to 15 comprises web bonding means 410, feeding means 411 to feed films of waterproof thermoplastics material from rolls 412, 413 and 414 to the bonding means, via web splitting means 415 and a separator 416, and take up means 417 to wind bags onto rolls 418.

The bonding means 410 comprises upper and lower relatively movable members 420 and 421, which members are mounted respectively above and below a web transit path therebetween, and which members incorporate perforators 422 and sets of heating elements, which sets confront each other across the web transit path. At least one of said members 420,421 is movably mounted so that the sets can be moved together and apart to vary the spacing therebetween and thus to vary the thickness of the web transit path.

The feeding means 411 includes first, second and third pairs driven or nip rollers 430, 431 and 432 to draw the firms along the web transit path, and drive means 419 to drive said rollers in unison and to rotate the rolls 412, 413, 414, and 418.

The web splitting means 415 comprises a fixed knife 433 which is mounted on a support 434 so as to bisect the films longitudinally into webs as the film material is fed to the knife, and a further support 435 carries a crosspiece 436 to which the separator 416 is attached. The latter is a strip of plastics material, such as P.T.F.E., having a relatively high melting point, or is of thin metal.

Figure 16:
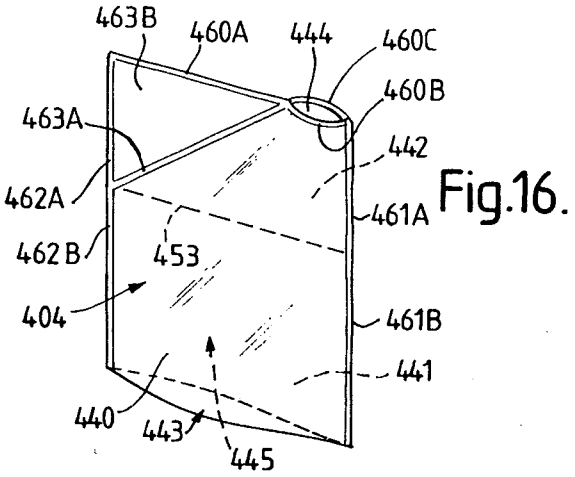
FIG. 16 is a perspective view of a further form of bag of the invention formed by the apparatus of FIGS. 12 to 15.
Figure 15:
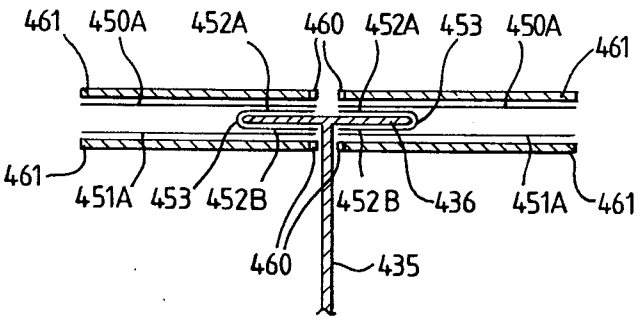
FIGS. 13, 14 and 15 are part sectional views showing portions of the apparatus of FIG. 12 respectively in plan, side and front elevation.

Referring to FIG. 16, the bag 404 comprises two outer walls 440 and 441 and an internal pocket 442. In this embodiment the bottom 443 of the bag is left open and a mouth 444, which opens into the pocket 442, is left open at the top of the bag.

Figure 13:
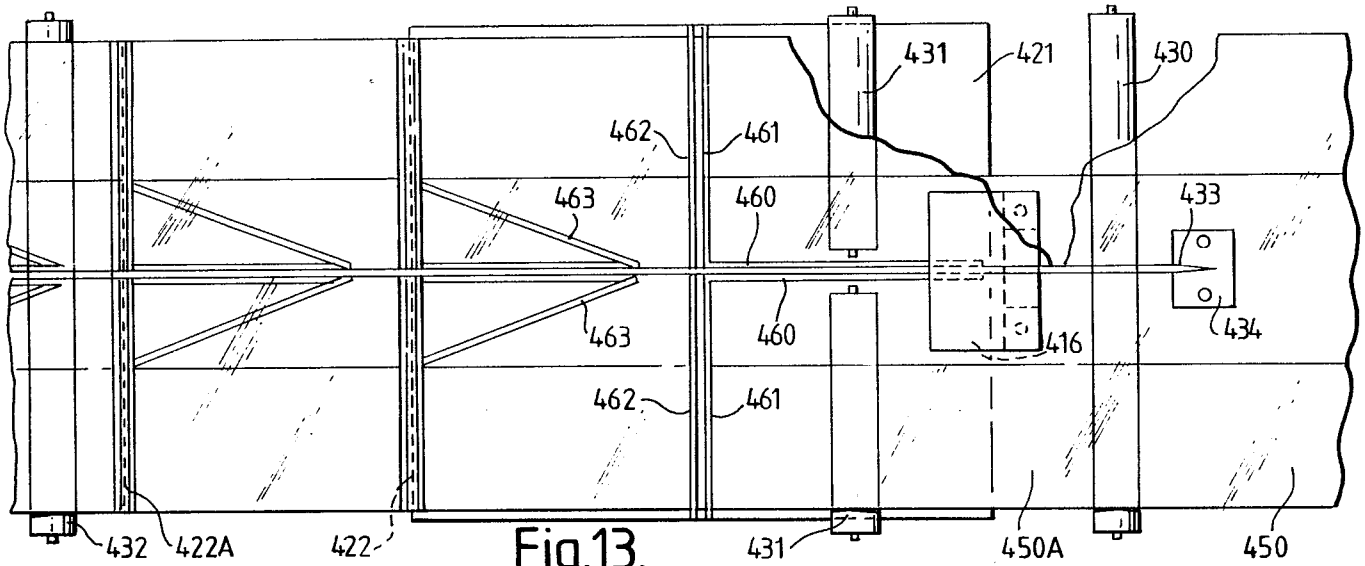
Figure 14:
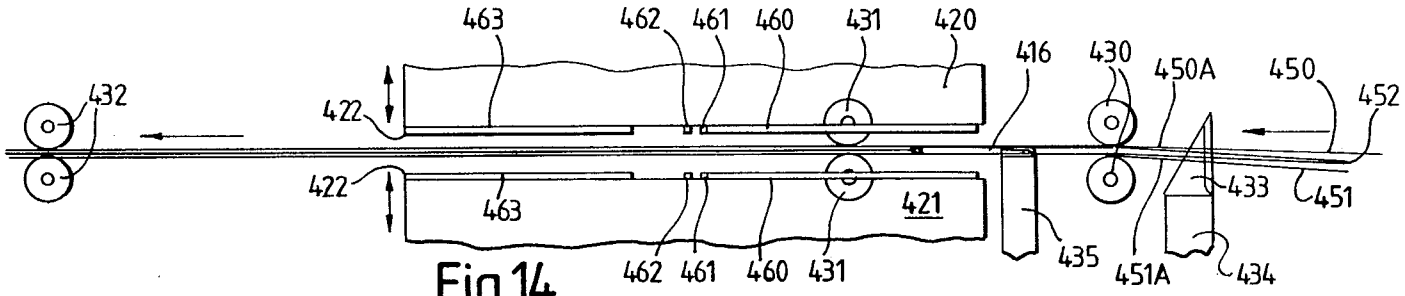

The bags are formed from an upper film 450 and a lower film 451 of a relatively robust sheet plastics drawn from the rolls 412 and 414, and an intermediate lay-flat tube 452 of a relatively frangible plastics film material drawn from the roll 413. The films 450, 451 with the flat tube 452 sandwiched therebetween are drawn by the rollers 430 to the knife 433 so that the sandwich is split longitudinally into two symmetrical runs of webs. In each run there is an upper web 450A and lower web 451A with one half of the tube 452 therebetween. Said half of the tube provides a single membrane folded to provide an upper intermediate web 452A and a lower intermediate web 452B each of lesser width than the webs 450A and 451A, and provides a junction fold 453 between said webs 452A and B, which fold 453 provides bottoms for the pockets 442. Said webs 450A, 451A, 452A and 452B abut to form a sandwich, and are drawn by the rollers 431 across the separator 416 so that the latter separates the webs 452A and B as they enter the bonding means. As shown in FIGS. 13 and 14, the separator 416 extends into the web transit path between the members 420 and 421 so as to hold apart portions of the webs 452A and B as said webs enter the path between said members.

Each set of elements comprises two similar arrays which are symmetrical about a longitudinal center line of the web transit path, which longitudinal center line is disposed between the two runs, the latter being guided by the rollers 431 and 432 so that the edges of the webs formed by the knife are parallel to said longitudinal center line.

Each array confronts a complementary array on the other member to form a pair, and comprises a first element 460 parallel to the center line, closely parallel to the second and third elements 461 and 462 perpendicular to the center line, and a fourth element 463.

In each pair of arrays the first elements 460 cooperate to form a top seam of the bag, which top seam comprises a first portion 460A which joins all four webs together and two portions 460B and 460C which, during formation, are separated by the separator 416, so that the portion 460B joins the top web 450A to the web 452A, and the portion 460C joins the bottom web 451A to the web 452B. The second elements 461 cooperate to form a first side seam of the bag which side seam comprises first portion 462A which extends from the top seam to the junction 453 to join together all four webs, and a second portion 462B which extends from the junction 453 to the bottom of the bag.

The drive means is arranged to drive the webs incrementally in steps of substantially one bag width, so that the top 460A and first side seams 462A, 452B are formed first for each bag by feeding the webs between the said members, closing the members together to nip the webs between heating the elements, and, when the elements have cooled to allow the seams to set, advancing the webs to bring the part formed bags therebetween the third and fourth elements.

The third elements 462 of each pair cooperate to form the second side seam 461A and 461B which extends from the mouth to the bottom of the bag; and the fourth elements 463 form a diagonal seam 463A which extends across a top corner portion 463B of the bag so that said portion 463B serves as a handle and is sealed from the pocket and the remainder of the interior of the bag.

The perforators 422 are disposed to make a line of perforations 422A between the second seam 462A of a finished bag and the first side seam 461 and B of the next adjacent bag as the members are closed to form the second and diagonal seams of the latter bag.

The so formed bags are connected by the perforated portions therebetween and are wound gently onto the roll 414.

When full, the rolls 414 of bags are taken to a known form of bag filling apparatus (not shown) wherein the bags are inverted and have measured amounts of a material (470—FIGS. 17 to 19) for mixing inserted into the compartments 445 via the open bottoms 443; and thereafter the bottoms 443 are closed by a seaming device (not shown) which forms bottom seams 465 (FIGS. 17 and 19) to seal the compartments with the material 470 therein. The individual, filled bags may be detached from one another and suitably packaged for sale.

Figure 17:
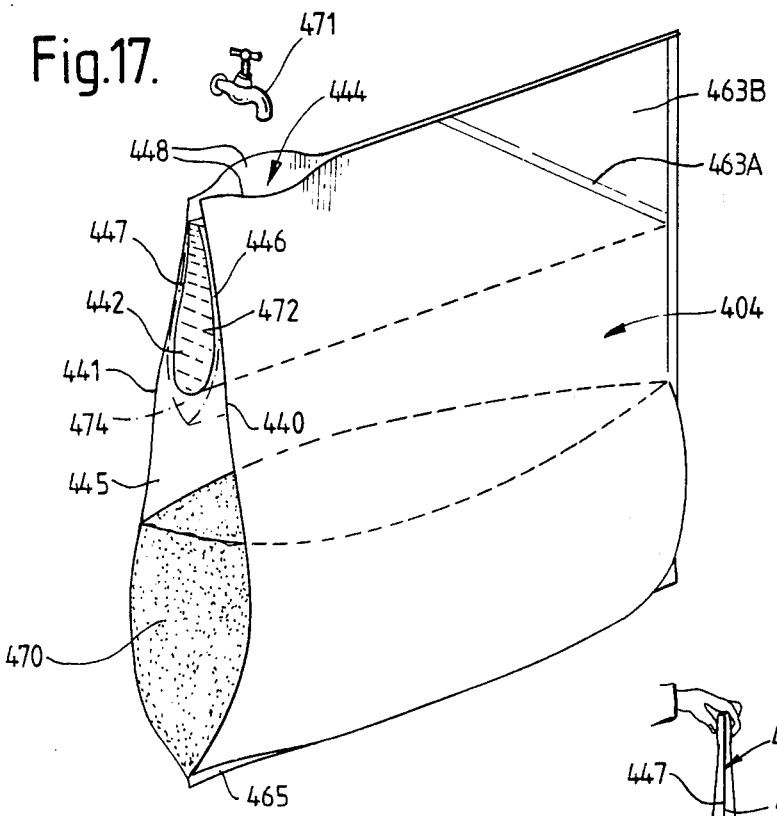
FIG. 17 is a part sectional perspective view of the bag of FIG. 16 used as a liquid measure.

The embodiment of bag 404, shown in FIGS. 16 to 19 comprises the two main outer walls 440 and 441 secured together along the sides and the top of the bag as described to define a main compartment 445 therebetween; two internal webs 446 and 447 which are secured together by the means 460A, 461A, 462A and 463A. The webs 446 and 447 extend into the main compartment 445 from the top of the bag and are joined together by the fold 453 to form the pocket 442 therebetween. Along the top of the bag, the wall 446 is joined to the adjacent wall 440 and similarly the wall 447 is joined to the wall 441, and the walls 446 and 447 are secured together along most but not all of the top of the bag so as to leave portions 448 defining the mouth 444 which opens into the pocket 442. The walls 446 and 447 normally lie in a flat condition in face to face abutting relationship, but the portions 448 are shown spaced apart in FIG. 17 to show the mouth 444 in an open condition ready to admit liquid to the pocket, e.g. from a tap 471. The pocket 442 serves as a measure for measuring a predetermined volume of the liquid 472 for mixing with the predetermined amount of the material 470. The diagonal seam 463A restricts the capacity of the pocket 442 so that, when filled to its restricted capacity, the pocket holds said predetermined volume. However, the seam 463A may be omitted and markings, not shown, may be printed on the bag, to indicate a particular level to which the pocket is to be filled with liquid 472, for measuring the liquid. The pocket is filled in the horizontal condition with the liquid 472, as shown in FIG. 17.

After the pocket has been filled, the mouth is closed, (e.g. by being held manually or by clamp or sealing means, or by the walls adjacent the mouth being doubled over or folded or held) and the pocket is burst or is ruptured by striking or thrusting inwards the main walls 446, 447, to discharge the liquid from the pocket into the main compartment 445.

Figure 18:
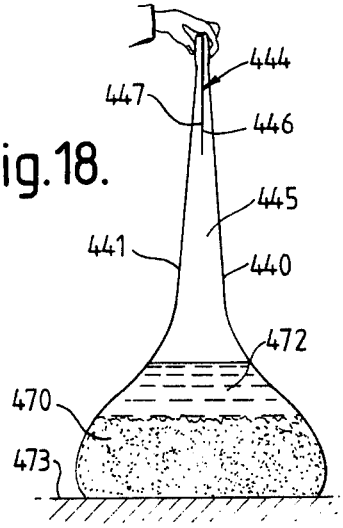
FIGS. 18 and 19 are sectional views showing the bag of FIG. 16 resting vertically and horizontally upon a surface prior to mixing of the liquid with a material contained in the bag.
Figure 19:
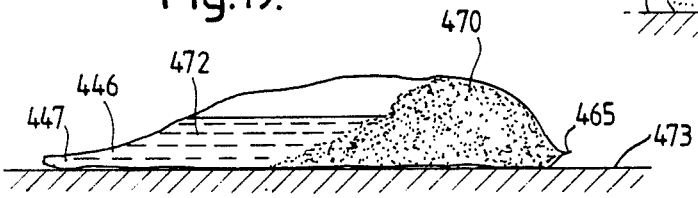

When the liquid is discharged from the pocket, the webs 446, 447 assume a face to face abutting relationship and are held together by a thin film of liquid as shown in the FIGS. 18 and 19.

In this condition the webs 446, 447 serves as a non-return valve between the main compartment and the mouth, so that the mouth can be released and the bag stood (FIG. 18) or laid on a supporting surface 473 as shown in FIG. 19, the walls 446,447 being further held together by the bulk of material and liquid. The contents can then be mixed by manipulating the bag to form a mixture and thereafter the bag can be opened to enable the mixture to be used.

The invention affords several advantages including:

(a) The pocket may be used simply as a non-return valve for a bag containing a liquid drink or may be used as a measure, (b) Liquid can be inserted into the pocket at a point and time of availability of the liquid, and can be held in the bag until the mixture is required for use.

(c) Where a mixture, such as custard, has to be mixed in two stages, the pocket can be used to measure a small first quantity of liquid, which is then mixed with the material, and then the compartment can be used as a measure for a final quantity of liquid which can be inserted via the mouth and pocket into the compartment and thereafter mixed with the mixture, because air will be trapped at the top of the compartment to ensure that the walls 446, 447 abut and to leave room for mixing without overstressing the walls of the bag.

(d) The user is protected from harmful or irritating dust or fumes usually caused by mixing dry materials with liquids.

(e) A mixture can be produced (without inconvenience, spillage or the use of mixing utensils) within the bag so as to be free from comtamination.

(f) The mixture is protected by the bag, e.g to prevent evaporation of the liquid.

(g) A corner can be cut from the bag to enable the mixture to be extruded e.g. into a slot, recess or cavity to be filled.

(h) Surplus material can be left in the bag for convenient disposal.

The invention is not confined to the precise details of the foregoing examples and many variations are possible within the scope of the invention. For instance, the shape, size and form of the bag may be varied.

The pocket is preferably made from a folded single membrane of weaker material than the main walls of the bag, so as to rupture easily, but the pocket walls may be made from individual films or webs with a frangible bond being provided between the lower margins of the pocket walls to form an easily ruptured weak seam.

The size, shape and disposition of the mouth can be varied as desired. For instance, in a vertically elongate bag, the mouth may extend substantially across the top of the bag. The mouth may be extended vertically to provide easily separable flaps or to form an inlet conduit which can be easily clamped shut or even tied in a knot to close the mouth, especially if a second material for mixing is accommodated in the pocket.

The heating elements may be of electrical resistance or ultrasonic or high frequency welding form, and may be arranged as desired to provide bags or any suitable shape or size having open bottoms, or closed bottoms and partially open sides, for filling.

I claim:

1. In a bag formed from bonded flexible waterproof film material with a compartment and a pocket within the bag, said bag comprising:

(a) first opposed walls defining the compartment and second opposed walls located between the first opposed walls and defining the pocket and a mouth opening into the pocket, (b) the pocket is interposed between the compartment and the mouth such that the pocket is separated from the compartment by the second opposed walls, (c) at least a portion of the pocket is frangible to allow the pocket to be ruptured, (c) said opposed walls are adapted to assume a face to face abutting relationship so that the abutting faces are held in a self-sealing position after rupture of the pocket to serve as a non-return valve between the compartment and the mouth, and (e) a removable dispenser holding section is disposed adjacent the pocket to close the mouth until use of the bag is required.

2. A bag as defined in claim 1 wherein the removable holding section includes a chamber in which a dispenser member is hermetically sealed within the bag.

3. A bag as defined in claim 2 wherein the removable holding section forms a top section that is separable from the bag along a frangible line of weakness and the dispenser member is a dispensing tube, said dispensing tube being effective for insertion into the mouth and rupturing the frangible portion of the pocket.

4. A bag as defined in claim 1 wherein the compartment has a material insertion opening, remote from the mouth, which can be sealed after insertion into the compartment of a desired material.

5. A bag as defined in claim 1 wherein the pocket is adapted to hold a predetermined quantity of liquid to serve as a measure.

6. A bag as defined in claim 1 wherein the walls of the pocket are formed from a single membrane disposed between said outer walls to project into the compartment.

7. A bag as defined in claim 6 wherein the single membrane is made from waterproof film material which is thinner in thickness than the thickness of the waterproof film material from which said outer walls are formed.

* * * * *